United States Patent [19]

Soykan et al.

[11] 4,261,412

[45] Apr. 14, 1981

[54] FINE GRAIN CASTING METHOD

[75] Inventors: Ferhun H. Soykan; John S. Huntington, both of New Hartford, N.Y.

[73] Assignee: Special Metals Corporation, New Hartford, N.Y.

[21] Appl. No.: 38,967

[22] Filed: May 14, 1979

[51] Int. Cl.[3] ..... B22D 27/02

[52] U.S. Cl. ..... 164/52; 164/252

[58] Field of Search ..... 164/52, 252, 46; 13/11, 13/12, 18 A, 18 R; 314/42, 43

[56] References Cited

U.S. PATENT DOCUMENTS

| | | | |
|---|---|---|---|
| 1,833,347 | 11/1931 | Avis | 164/52 |
| 2,116,218 | 5/1938 | Seil | 13/11 |
| 2,688,169 | 9/1954 | Gruber et al. | 164/52 |
| 2,866,700 | 12/1958 | Bohnet et al. | 75/10 C |
| 3,226,223 | 12/1965 | Bussard | 164/52 |
| 3,847,205 | 11/1974 | Soykan et al. | 164/155 |
| 3,920,062 | 11/1975 | Soykan et al. | 164/4 |
| 4,066,117 | 1/1978 | Clark et al. | 164/46 |

FOREIGN PATENT DOCUMENTS

| | | | |
|---|---|---|---|
| 463965 | 11/1973 | Australia | 13/11 |

OTHER PUBLICATIONS

"Differential Thermal Analysis Detects Superalloy Reactions", by Burton et al., Metal Progress, 10/75.

*Primary Examiner*—Robert D. Baldwin
*Assistant Examiner*—K. Y. Lin
*Attorney, Agent, or Firm*—Vincent G. Gioia; William J. O'Rourke, Jr.

[57] ABSTRACT

A method for fine grain casting prealloyed metal comprising the steps of providing first and second electrodes within an enclosed chamber, said first and second electrodes being spaced so as to form a gap between them, at least one of said electrodes being an ingot having a composition corresponding to the composition of a prealloyed continuous casting to be formed; and heating said electrodes to a temperature sufficient to melt said at least one electrode into molten metal which falls from said at least one electrode into a mold wherein the molten metal is at least partially solidified; wherein the improvement comprises causing said molten metal to fall directly from said at least one electrode into a mold so as to result in a casting having a fine grained structure.

9 Claims, 5 Drawing Figures

ELECTRODE
ELECTRODE
(+)
(−)
V
60°

FINE GRAIN CASTING METHOD

BACKGROUND OF THE INVENTION

1. Field of the Invention

The invention relates to a method and apparatus for forming metal castings having fine grained structures.

2. Description of the Prior Art

In casting metal articles it is sometimes important that a cast billet be formed which may subsequently be worked so as to impart desired strength and other structural properties. Thus, for example, it may be necessary to subject cast billets to a hot working process by forging them several times to strengthen them. In those cases where the grain size of the billet is large, the hot working process may itself involve several steps. This, of course, is both costly in terms of time and energy. Also, by virtue of the large grain sizes often present in castings and as a result of the lengthy but necessary forging and rolling processes, the casting has a tendency to crack thus making it commercially undesirable.

Thus, if a satisfactory method of commercially producing fine grain castings were available it would be possible to simplify the hot working operations as well as reduce costs while obtaining a product of improved quality.

Known methods of making fine grain castings include casting atomized molten metal as well as casting the molten metal after it has partially solidified.

The atomization technique essentially comprises using an inert gas to atomize a molten metal and then catching the atomized metal in a container just before it has become solidified.

Atomization techniques have proven unsatisfactory since some of the inert gas used to atomize the metal becomes trapped within the final solidified metal billet thus lowering its quality.

When casting molten metals after they have partially solidified it is necessary that the temperature throughout the process be carefully controlled and kept constant while the metal, in a "mushy state", is being poured. The necessity for careful process control inherently complicates the operation.

Attempts at what is known as "drip casting" have involved the use of consumable electrodes which are heated to supply molten alloy. The alloy is then passed into a tundish or holding induction pot from which it is poured into a water cooled mold. However, use of a tundish requires that the tundish be preheated so as to prevent premature freezing of the molten metal. A process and apparatus such as this is illustrated by FIG. 3 of U.S. Pat. Nos. 3,847,205 and 3,920,062, the disclosures of which are hereby incorporated by reference. The tundish thus complicates the process and apparatus by the addition of a costly extra step which must be carefully controlled and monitored.

SUMMARY OF THE INVENTION

It is, therefore, an object of the invention to provide a method and apparatus for fine grain casting in which the above disadvantages of the prior art may be obviated.

According to the invention an apparatus is provided for fine grain casting of prealloyed metal which comprises: an enclosed chamber for striking an arc therein, wherein at least one of said electrodes is an ingot having a composition corresponding to the composition of a casting to be ultimately formed; means for raising the temperature of said first and second electrode up to the melting point of said at least one electrode, thus resulting in molten metal which falls from said electrode; and an open-ended mold arranged so as to directly receive said falling molten metal from said electrode as it melts and drips off said electrode.

In one embodiment of the invention the apparatus comprises electrode oscillation means for oscillating said first and second electrodes with respect to one another. Alternatively, electrode rotation means may be attached to the first and second electrodes to rotate the electrodes in opposite directions to one another.

The method of the invention for fine grain casting prealloyed metal comprises the steps of: providing first and second electrodes within an enclosed chamber, said first and second electrodes being spaced so as to form a gap between them, at least one of said electrodes being an ingot having a composition corresponding to the composition of a prealloyed continuous casting to be formed; heating said first and second electrodes to a temperature sufficient to melt said at least one electrode into molten metal which falls from said at least one electrode into a mold wherein the molten metal is at least partially solidified; the improvement comprising causing said molten metal to fall from said at least one electrode directly into said mold so as to result in a casting having a fine grained structure.

When using the method according to the invention, the electrode or electrodes comprising the prealloyed consumable metal may be oscillated such that the electrodes melt evenly. Also, alternative power sources may be used to apply the voltage to the electrodes depending on the melting point of the electrodes.

DESCRIPTION OF THE PREFERRED EMBODIMENTS

According to the invention at least one clean consumable electrode, i.e., an ingot having a composition corresponding to the composition of a casting to be ultimately formed, is first heated to its melting temperature. When either one or both of the electrodes are so heated, molten metal drips downwardly by virtue of gravitational force directly into a mold. As will later be explained, it is sometimes necessary to go to very high temperatures to achieve a completely molten metal having no unmelted components therein.

The electrodes may be heated by a variety of means depending upon the melting point of the electrodes. One means of heating the electrodes is to pass an AC or DC current between the two electrodes when they are arranged opposite one another along a common longitudinal axis with a gap located therebetween. The electrodes themselves are preferably located within a chamber which is maintained under vacuum or under controlled atmosphere conditions.

By virtue of the design of the apparatus the molten droplets dripping from the electrodes fall directly into the mold. As a result, the droplets contain no substantial superheat so that rapid solidification takes place and fine grain formation occurs as the latent heat of fusion of the molten metal is transferred by means of radiation and conduction. Conventional supplemental cooling means may be used where necessary to remove the latent heat of fusion of the molten metal. Thus, when the droplets pile on top of one another, fine grain solid billet and hollow billet as well as semipreformed shapes may be produced.

As was pointed out previously, the electrodes themselves comprise an alloy having the composition of the desired final casting. Accordingly, the invention is not limited to any specific alloy or class of alloys. By way of example, the process may be applied to those materials which can be melted by electrical arcing.

Figures 1, 1A, 1B:
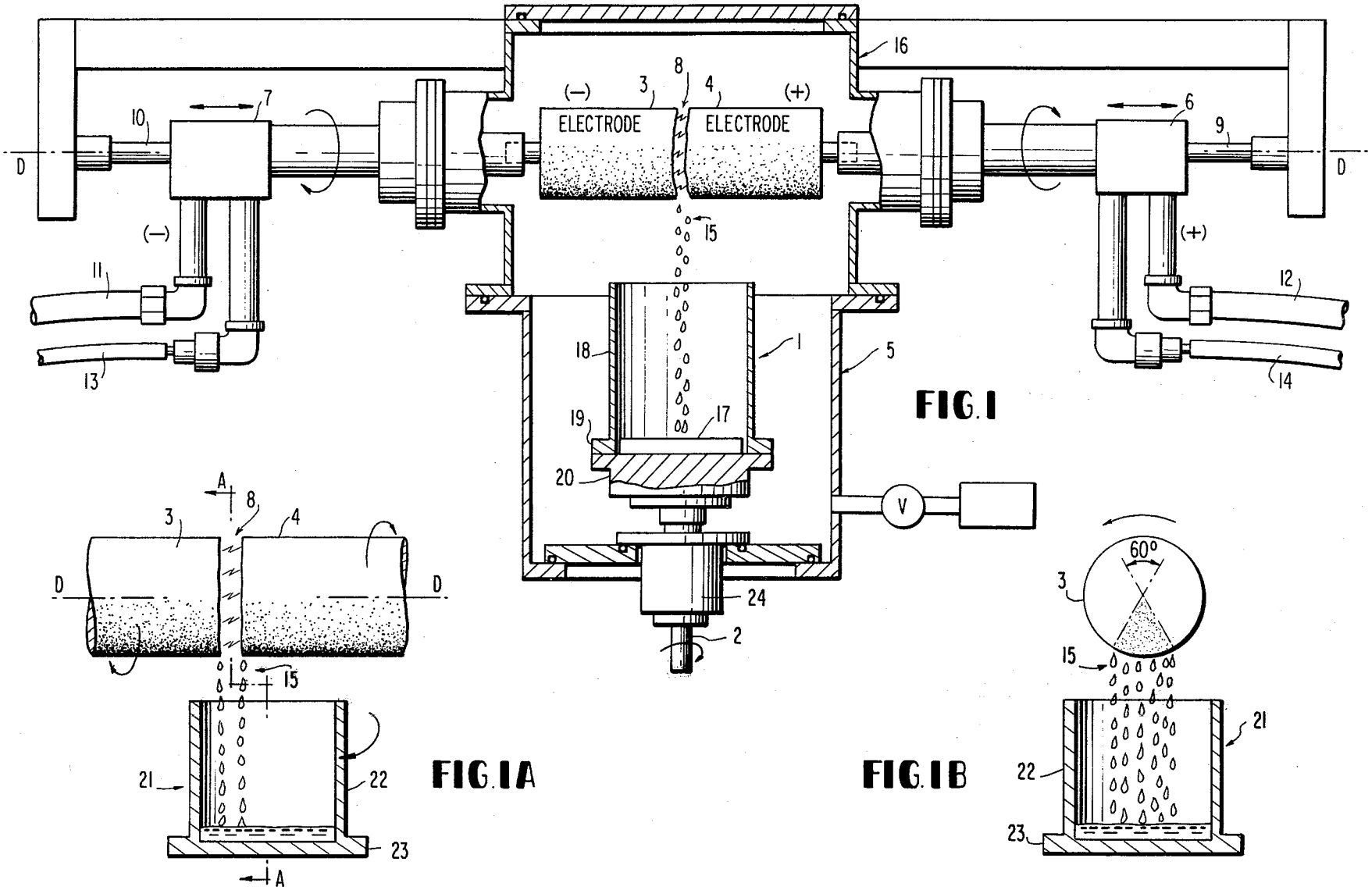
FIG. 1 illustrates a first embodiment of the fine grain casting apparatus.
FIG. 1A illustrates a cutaway view of a fine grain casting apparatus with the central axis of the mold offset with respect to the stream of falling molten metal droplets.
FIG. 1B is a cross-sectional view of the apparatus along line A—A of FIG. 1A.

FIG. 1 illustrates a first embodiment of the invention in which a mold 1 may be displaced. In a preferred embodiment mold displacement means may be provided, for example, the mold 1 may be rotated by means of a motor 24 and axle 2 arranged beneath the consumable, very cleanly melted VIM (vacuum induction melted) electrodes 3 and 4 all located within a head chamber 16 and a sealed chamber 5. A vacuum or other controlled atmosphere is maintained within the chamber so as to maintain product quality. As illustrated, a vacuum pump system is connected to the chamber.

As shown in FIG. 1, the casting apparatus is provided with means 6 and 7 for laterally adjusting the electrodes to provide the necessary gap between them. To promote even burnoff the electrodes should be oscillated by at least 180° in opposite direction to one another.

The electrodes 3 and 4 are connected to a power supply by means of flexible power leads 11 and 12 respectively. These leads provide the voltage causing amperage to flow and heat the electrodes. In order to further compensate for the problem of unequal burnoff rates of the electrodes when using DC voltage, the respective polarities of each of the electrodes are preferably reversed by means of a polarity reversing switch (not shown). The furnace parts which may be subject to overheating as a result of the high current are cooled by a fluid system, preferably water, flowing through flexible hoses 13 and 14.

In operation, the electrodes either or both of which may be consumable, are brought to their melting point by means of current flowing through the electrodes and across the gap 8. The resulting molten metal forms into droplets 15 which drip off the electrodes and fall by gravity into the rotating mold 1 thus forming a billet on base 17. As was pointed out previously, the temperature of the falling droplets is uniform, and since the droplets fall directly into the mold without first passing into a runner or holding pot, their relative temperature and "mushy" texture remain uniform as they cool. This results in the highly desirable fine grain structure previously referred to.

The mold itself may assume various forms and shapes depending upon the shape of the cast metal to be ultimately produced. As illustrated in FIG. 1, the rotating mold 1 comprises a circular mold wall 18 supported by an annular flanged portion 19 resting upon a mold support 20.

FIG. 1A illustrates a cutaway view of an embodiment similar to FIG. 1 with the electrodes aligned along a common central axis D—D except that in this embodiment the central axis of the mold 21 is offset with respect to the stream of falling droplets. FIG. 1A also illustrates an alternative mold structure with a circular wall 22 mounted on a flat solid bottom portion 23.

FIG. 1B illustrates the embodiment of FIG. 1A as seen along line A—A. The figure illustrates the droplets 15 falling into the offset mold 21. The droplets 15 have been found to drip off the consumable electrode along a periphery of the cylindrical electrode 3 corresponding to an arc of 60°. The width of the falling curtain of droplets is equal to the radius (r) of the cylindrical electrode 3. By properly offsetting the central axis of the mold 21 with respect to the falling droplets a fine grain casting is evenly and uniformly built up as the mold rotates. The mold is arranged in a plane approximately perpendicular to the curtain of falling metal.

Figure 2:
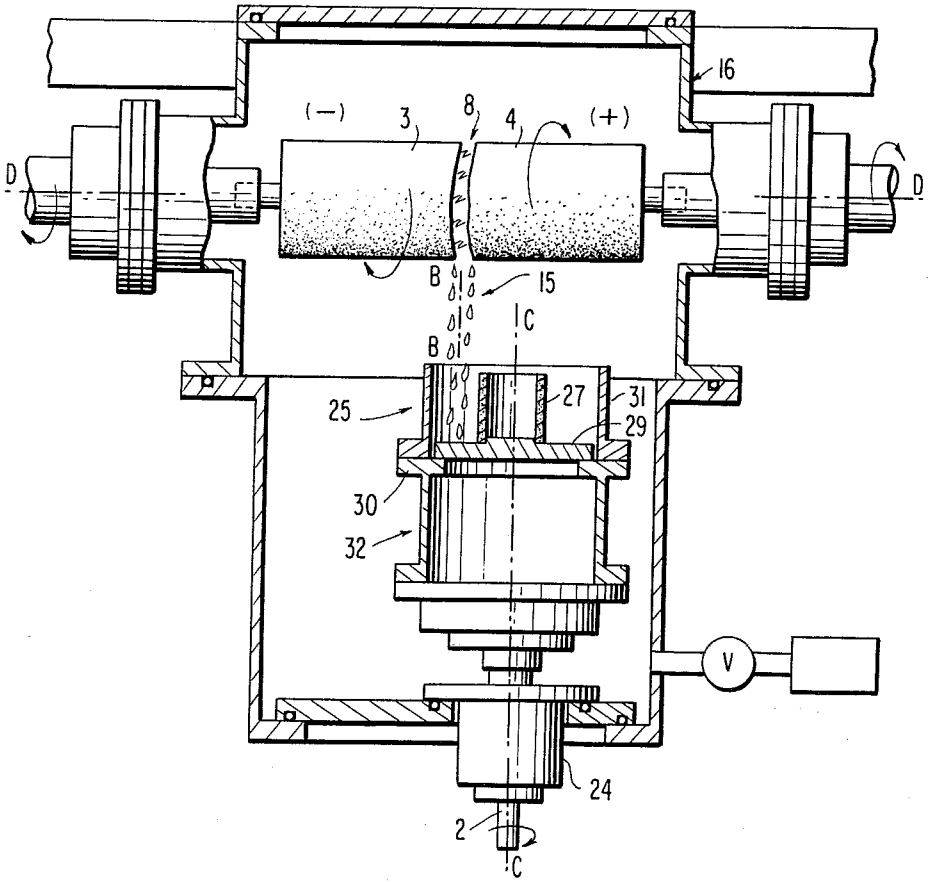
FIG. 2 illustrates a casting apparatus having a mold offset with respect to the falling molten metal.

FIG. 2 illustrates a casting apparatus similar to that shown in FIG. 1. Once again, opposing consumable electrodes 3 and 4 are arranged within head chamber 16 and are rotated or oscillated while being heated by applying a voltage across the electrodes to arc the gap between them. However, in the casting apparatus illustrated, an annular mold 25 is arranged such that the molten metal droplets fall within the annular portion of the mold as it rotates resulting in an even distribution of the molten metal in the annular zone surrounding the core. Thus, the central axis C—C of the mold is offset with respect to the plane B—B axially bisecting the curtain formed by the falling droplets. As shown, the mold comprises an inner cylindrical collapsible core 27 mounted on a solid base 29 bordered by annular wall 31. Base 29 is itself supported by the annular rim 30 of support cylinder 32. Collapsible core 27 has the advantage of permitting shrinkage of the solidifying metal, as it cools, without cracking. The core may be made from such a material which has higher or equal melting temperature of the consumable electrodes. Motor 24 rotates the mold at a velocity based upon the melt rate so as to build up an even cast of the material. The rotational velocity of the mold should not exceed 60 revolutions per minute.

Figure 3:
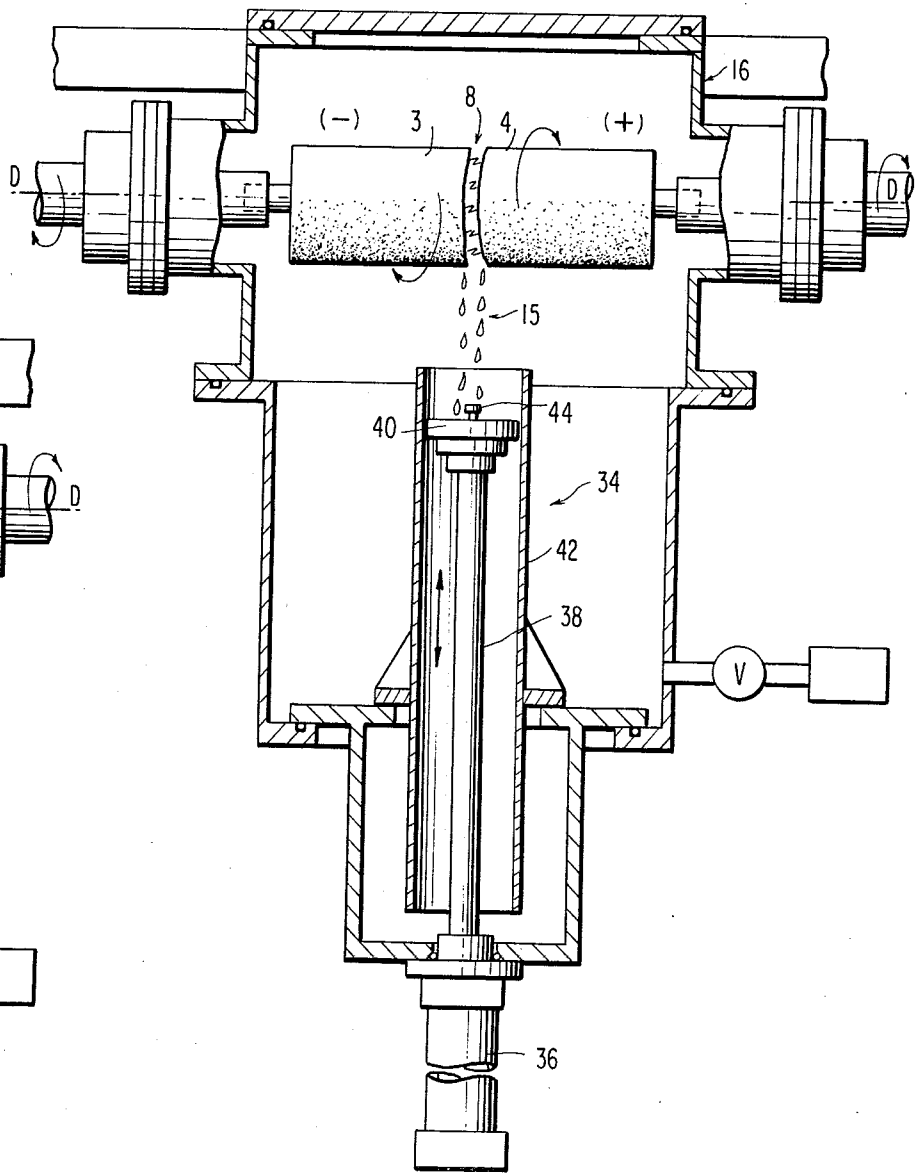
FIG. 3 illustrates a casting apparatus having a mold with a stationary cylindrical wall.

FIG. 3 once again illustrates a casting apparatus resembling the previous two embodiments with the exception that the cylindrical mold wall is stationary. As shown, mold 34 comprises a stationary cylindrical wall 42 surrounding a base member 40 with upstanding member 44 supported by a piston 38 mounted for reciprocal movement within a withdrawal cylinder 36. In operation, the consumable electrodes melt and the molten liquid drips off the electrodes and into the mold 34. As the molten metal droplets fill the mold, base 40 is lowered by piston 38 thus pulling down the ingot by virtue of upstanding member 44 which grips the solidifying ingot. By this method, it is possible to cast ingots having lengths of ten to fifteen times their diameter. These ingots may then be used as a super clean remelt stock. The ingots may be processed through a hot isostatic process to improve densification and grain control if such is desired.

Although the Figures each refer to opposing electrodes spaced apart by a gap which are heated by applying a voltage across them to arc the gap, the apparatus and method of the invention are not limited to this particular heating means. Under certain circumstances it may be necessary to significantly superheat the metals to temperatures on the order of 2900° F. (1590° C.) to melt carbides or other materials which may be present so that they may evenly dissolve in the molten metal. To do this, the heating means illustrated in the drawings may prove inadequate. Unless alternative or supplemental heating means are used, the carbides or other materials will be cast in the form of large blocky structures and the resulting ingot would not have the same carbide structures as in powder products even though it would have an overall fine grain structure. This criticality of molten temperature is discussed in an article entitled *Differential Thermal Analysis Detects Superalloy Reactions,* by Claudia J. Burton and William J. Boesch, which appeared in METALS PROGRESS, October 1975, with specific reference to an NiTaC-13 and Udimet IN-738 (containing 1.7 Ta and 0.17 C).

Accordingly, in those instances where high superheat treatment becomes necessary, alternative and supplemental heat sources such as induction heating means, an electron beam skull melter, laser heating or the like may be used as heating means.

EXAMPLE

Two 7⅞ inch diameter electrodes made of 0.15% carbon, 14% chromium, 8% cobalt, 3.5% molybdenum, 3.5% tungsten, 3.5% colombium, 2.5% titanium, 3.5% aluminum, 0.01% boron, 0.05% zirconium, balance nickel, initially produced by vacuum induction melting technique were melted to produce droplets which were drip cast in a mold 6 inches high and 11 inches in diameter. The mold itself was made of steel pipe and the inside was lined with fiberfrex paper which was about 0.040 inch thick.

The current fed through the electrodes was 6,000 amperes at a voltage of about 23 volts. With this power input a melt rate of 17.8 lbs. per minute was achieved. Solidification of the molten metal did not permit formation of a liquid meniscus and the droplets had a tendency to pile up on top of one another; and molten droplets ran from the center to the edges of the mold at an angle of about 10° to 15° from the horizontal.

The resulting ingot was removed from the mold and longitudinally etched with a cut to observe pipe shrinkage and grain structure. The ingot represented a classical shrinkage pipe which was shorter than statically cast ingot pipes. The grains were very fine, between about 1/32" and 1/16" at the center, gradually growing towards the outer edges of the ingot. Nevertheless, the extreme outer surface of the ingot exhibited a very fine grain resembling the grain at the center of the ingot.

It may thus be seen from the example that the drip casting method of the invention provides an ingot having a fine grain structure even at melt rates greater than 15 lbs. per minute. By way of comparison, the inventive drip casting process makes it possible to melt three times faster than with known VAR (vacuum arc remelting) techniques while, nevertheless, achieving very fine grain structure.

The invention has been described by way of example with reference to particular metals, melt rates, heating means and the like. It is to be understood, however, that the invention is by no means confined as to any of the parameters set forth but it is to be construed only as being limited by the scope of the claims defining the invention.

We claim:

1. A method of fine grain casting prealloyed metal comprising the steps of:

(a) providing first and second electrodes within an enclosed chamber, said first and second electrodes being spaced so as to form a gap therebetween, at least one of said electrodes being an ingot having a composition corresponding to the composition of the prealloyed metal casting to be formed; and (b) heating said first and second electrodes to a temperature sufficient to melt said at least one electrode into molten metal droplets which fall from said at least one electrode into a mold wherein the molten metal droplets is at least partially solidified before reaching the mold surface;

wherein the improvement comprises causing said molten metal droplets to fall by gravity from said at least one electrode directly into said mold disposed below said gap, prior to complete solidification of said molten metal droplets so as to result in a casting having a grain size of less than about 1/16 inch throughout.

2. The method of fine grain casting as defined by claim 1, which further comprises rotating said mold in a plane approximately perpendicular to said falling molten metal droplets and offset in relation thereto, so as to evenly distribute said molten metal within said mold as it rotates.

3. The method of fine grain casting as defined by claim 1, which further comprises oscillating said at least one electrode such that said at least one electrode melts evenly.

4. The method of fine grain casting as defined by claim 1, which further comprises arranging said first and second electrodes along a common longitudinal axis and rotating said first and second electrodes in opposite directions about said longitudinal axis.

5. The method of fine grain casting as defined by claim 4, wherein said mold is annular and said method further comprises rotating said mold around an axis perpendicular to said longitudinal axis such that said molten metal is evenly distributed as said droplets fall into said mold.

6. The method of fine grain casting as defined by claim 1, wherein said at least one electrode is heated to a temperature not significantly above its melting point such that said molten metal rapidly solidifies in said mold as a result of removing the latent heat of fusion of the molten metal.

7. The method of fine grain casting as defined by claim 6, which comprises removing said latent heat of fusion by cooling said mold.

8. The method of fine grain casting as defined by claim 1, which further comprises heating said first and second electrodes by applying DC power across said electrodes and periodically reversing the polarity.

9. A prealloyed metal article having a grain size less than about 1/16 inch produced by the process of claim 1.

* * * * *